US011684079B2

(12) United States Patent
Cruz

(10) Patent No.: US 11,684,079 B2
(45) Date of Patent: Jun. 27, 2023

(54) CIGAR TOBACCO STRIPS AND A METHOD FOR PACKAGING THE SAME

(71) Applicant: Keren Cruz, Carolina, PR (US)

(72) Inventor: Keren Cruz, Carolina, PR (US)

( * ) Notice: Subject to any disclaimer, the term of this patent is extended or adjusted under 35 U.S.C. 154(b) by 674 days.

(21) Appl. No.: 15/802,141

(22) Filed: Nov. 2, 2017

(65) Prior Publication Data

US 2018/0289053 A1 Oct. 11, 2018

Related U.S. Application Data

(60) Provisional application No. 62/416,461, filed on Nov. 2, 2016.

(51) Int. Cl.

| | |
|---|---|
| ***A24B 3/12*** | (2006.01) |
| ***A24B 3/04*** | (2006.01) |
| ***A24B 3/14*** | (2006.01) |
| *A24D 1/02* | (2006.01) |
| *A24C 5/46* | (2006.01) |

(52) U.S. Cl.

CPC ..... *A24B 3/12* (2013.01); *A24B 3/04* (2013.01); *A24B 3/14* (2013.01); *A24C 5/46* (2013.01); *A24D 1/022* (2013.01)

(58) Field of Classification Search

CPC .... A24C 5/20; A24C 5/40; A24C 5/46; A24C 1/04; A24B 3/14

See application file for complete search history.

(56) References Cited

U.S. PATENT DOCUMENTS 3,037,411 A * 6/1962 Skarstrom ..... B65H 35/06 83/226

* cited by examiner

*Primary Examiner* — Kelly M Gambetta
*Assistant Examiner* — Katherine A Will
(74) *Attorney, Agent, or Firm* — Eugenio J. Torres-Oyola; Victor M. Rodriguez-Reyes; Rafael Rodriguez-Muriel

(57) ABSTRACT

A cigar tobacco strips and a method for rolling and packaging the same is provided. The cigar tobacco strip is rolled into cylindrical shape and placed within an enveloping means. The tobacco strip is wrapped into cylindrical form causing the cigar tobacco paper to form a plurality of layers, wherein said layer comprises a double strip section. The rolled tobacco strip is then placed inside an enveloping means. The encased tobacco strip within the enveloping means allows for the tobacco strip to keep a cylindrical shape until delivered and used by a consumer. The enveloping means may maintain the moisture for longer time due to the rolling method prior to delivery to a consumer.

2 Claims, 3 Drawing Sheets

CIGAR TOBACCO STRIPS AND A METHOD FOR PACKAGING THE SAME

STATEMENT REGARDING FEDERALLY SPONSORED RESEARCH AND DEVELOPMENT

N/A

RELATED APPLICATIONS

N/A

BACKGROUND OF INVENTION

Field of the Invention

The present disclosure relates to a system and a method for wrapping and packaging a cigar tobacco strips.

Background of the Invention

It is becoming more popular for a tobacco consumer to wrap their own cigarettes. Several methods and packages of tobacco paper had been discussed for years. One of the problems for a consumer that wrappers his/her own cigarettes is that most of the cigarette wrappers are sold in packages wherein the cigar tobacco paper is flat. Further, another problem is the life span of the moist tobacco paper.

Therefore, there is a need for an improved cigar tobacco paper and method of packaging a cigar wrapper and/or cigar tobacco strip for shipment to an end user. More specifically, a need exists for a cigar tobacco paper and a method for transporting a cigar wrapper that may be kept moist until utilized by the end user.

Further, a need therefore exists for an improved cigar tobacco strip and method of packaging a cigar wrapper for shipment to and end user wherein the cigar wrapper is kept moist, and kept in a pre-rolled state during shipment, for easy use and creation of a finished cigar by a consumer.

SUMMARY OF THE INVENTION

A primary object of the present disclosure is to provide a cigar tobacco strip product and a method for wrapping and packaging a cigar tobacco strip that may be opened by a user and filled with the user's substance of choice by the, such as tobacco.

Further, the present invention relates to a method for wrapping and packaging a cigar tobacco strip wherein the cigar tobacco paper stays moist during transport of the cigar tobacco strip to the user.

Another object is to provide a cigar tobacco strip and method of packaging a cigar wrapper and/or cigar tobacco strip for shipment to an end user. More specifically, a need exists for a cigar tobacco strip and a method for transporting a cigar wrapper that may be kept moist until utilized by the end user.

Yet another object of the present disclosure is to provide a cigar tobacco strip and method of packaging a cigar wrapper for shipment to and end user wherein the cigar wrapper is kept moist, and kept in a pre-rolled state during shipment, for easy use and creation of a finished cigar by a consumer.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

The system of the invention itself, both as to its configuration and its mode of operation will be best understood, and additional objects and advantages thereof will become apparent, by the following detailed description of a preferred embodiment taken in conjunction with the accompanying drawing.

When the word "invention" is used in this specification, the word "invention" includes "inventions", that is, the plural of "invention". By stating "invention", the Applicant does not in any way admit that the present application does not include more the one patentable and non-obviously distinct invention and Applicant maintains that the present application may include more than one patentably and non-obviously distinct invention. The Applicant hereby asserts, that the disclosure of the present application may include more than one invention, and, in the event that there is more than one invention, that these inventions may be patentable and non-obvious one with respect to the other.

Further, the purpose of the accompanying abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DESCRIPTION OF THE PREFERRED EMBODIMENTS

Figure 1:
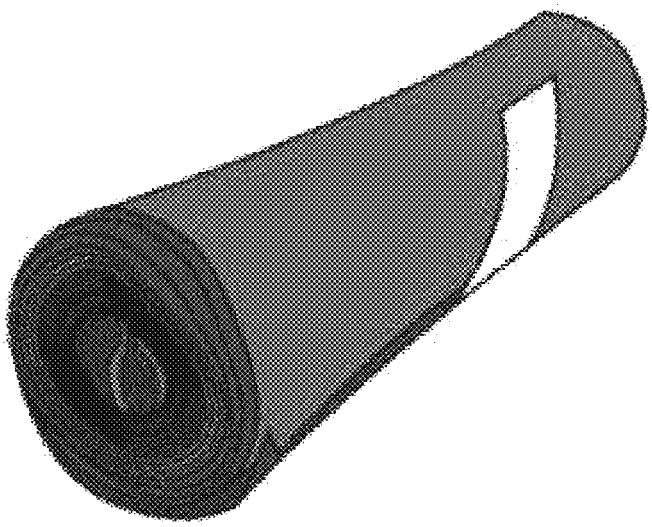
FIG. 1 shows a first exemplary embodiment of the rolled cigar tobacco strip in accordance with the principles of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

As shown in FIG. 1, the cigar tobacco strip is wrapped into a plurality of layers to be formed into a cylindrical shape.

Figure 2:
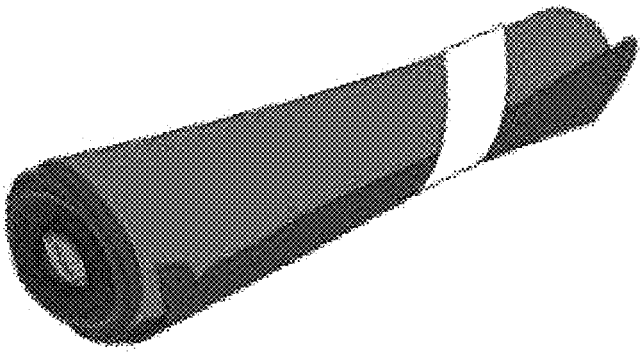
FIG. 2 shows a perspective view of the first exemplary embodiment of the rolled cigar tobacco strip in accordance with the principles of the present invention.

FIG. 2 shows another perspective view of the cigar tobacco strip. As shown, each plurality of layer is not formed by single strip section but instead it is formed by two side of the strips contacting each other while are rolled. The center of the rolled cigar tobacco strip comprises a small open space wherein no other material nor object is inserted to maintain the rolled cigar tobacco strip while it is positioned in the enveloping means.

In a preferred embodiment of the present invention, the cylindrical rolled cigar tobacco strip is configured to easily fit into the enveloping means.

Figure 3:
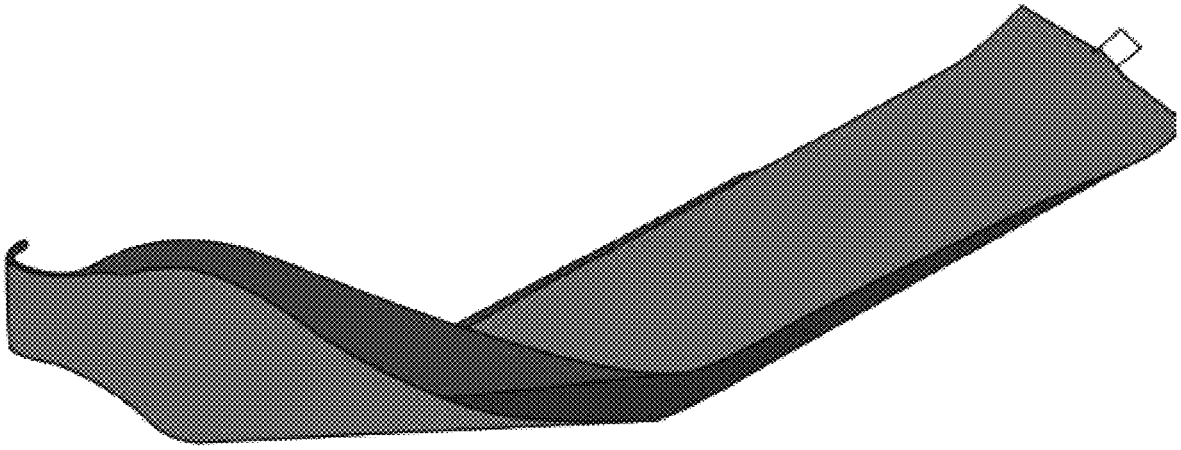
FIG. 3 shows an exemplary embodiment of the method for rolling method of cigar tobacco strip into a package in accordance with the principles of the present invention.
Figure 4:
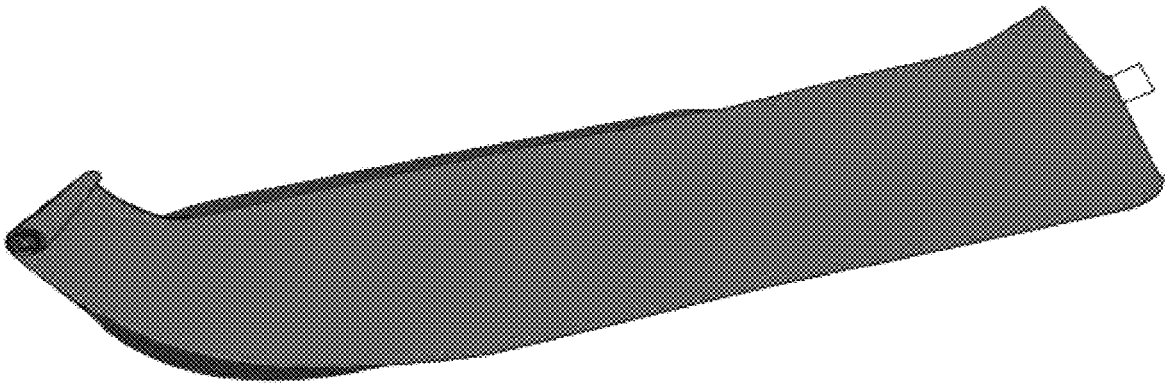
FIG. 4 shows a second exemplary embodiment of the method for rolling method of cigar tobacco strip into a package in accordance with the principles of the present invention.

FIG. 3 is directed to the rolling process for the rolled cigar tobacco strip. As shown the strip is bend in such way that the same part of the strip is exposed while the other is in close contact. Having the present configurations assist to preserve the moist on the Tabaco strip. One of the advantages is that the surface of the strip that is intended to interact or in close contact with the user's substance of choice is different from the surface that is intended to be in close contact with the user's hand or finger while smoking. Therefore, by bending the strip and provide a close contact between the surface which is intended to be in close contact with the substance of choice assists to preserve the moist at the rolled cigar tobacco strip. FIG. 4 is intended to show the process while the cigar tobacco strip is rolled after being bend.

Figure 5:
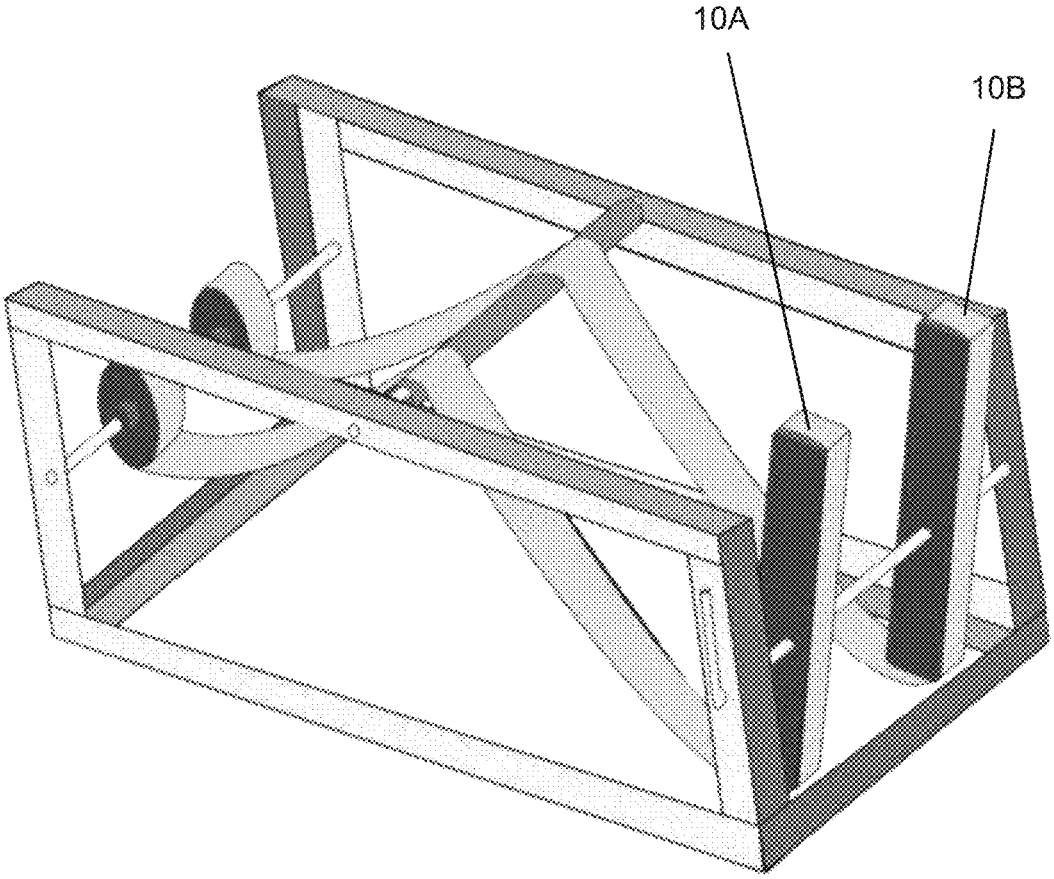
FIG. 5 shows the apparatus for forming the tobacco strip before it is rolled in accordance with the principles of the present invention.

FIG. 5 is directed to the apparatus used to create the cigar tobacco strip at a standard length. The tobacco is passed through a first roll which tends to remove wrinkles from the prime material. The second roll continues the wrinkle free process. The second roll may contain flavor to be add to the cigar tobacco strip if preferred. Finally, a length adjuster 10A, 10B is used to clearly provide a preferred length on the cigar tobacco strip. Once the preferred length is established by the length adjuster 10A, 10B the cigar tobacco strip is cut and removed. After the cigar tobacco strip is cut to have approximately the same length as the length adjuster 10A, 10B, said strip is bend and the rolling process, as explained above, starts.

The invention is not limited to the precise configuration described above. While the invention has been described as having a preferred design, it is understood that many changes, modifications, variations and other uses and applications of the subject invention will, however, become apparent to those skilled in the art without materially departing from the novel teachings and advantages of this invention after considering this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means-plus-function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patentable distinguish any amended claims from any applied prior art.

The invention claimed is:

1. An apparatus for making cigar tobacco strips at a standard length, comprising:

a first cylindrical tube;

a second cylindrical tube;

a ramp;

a rectangular block;

a base, comprising two left lateral vertical support beams and two right lateral vertical support beams in a rectangular configuration;

wherein said two left lateral vertical support beams each comprise a top part and a bottom part;

wherein said two right lateral vertical support beams each comprise a top part and a bottom part;

two horizontal beams, each comprising a top part and a bottom part;

wherein said first cylindrical tube is attached to said two left lateral vertical support beams;

wherein said second cylindrical tube is attached to said two horizontal beams;

wherein said ramp extends from said base to said second cylindrical tube in a diagonal configuration;

wherein said rectangular block is attached to said two right lateral vertical support beams;

wherein the bottom part of said two left lateral vertical beams and said two right lateral vertical beams is attached to said base at each corner of said base; and wherein the top part of said two left lateral vertical beams and said two right lateral vertical beams is attached to the bottom part of said two horizontal beams at each end of said two horizontal beams.

2. The apparatus of claim 1, wherein said second cylindrical tube contains flavor.

* * * * *